US010415871B2

(12) United States Patent
Eom et al.

(10) Patent No.: US 10,415,871 B2
(45) Date of Patent: Sep. 17, 2019

(54) EVAPORATOR DRIP PAN HAVING A HEAT ABSORBING COATED INNER SURFACE

(71) Applicant: LG ELECTRONICS INC., Seoul (KR)

(72) Inventors: Changwon Eom, Seoul (KR); Suwon Lee, Seoul (KR); Chongyoung Park, Seoul (KR); Minhyuk Lee, Seoul (KR); Sung Jhee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 29 days.

(21) Appl. No.: 15/643,858

(22) Filed: Jul. 7, 2017

(65) Prior Publication Data

US 2018/0010843 A1 Jan. 11, 2018

(30) Foreign Application Priority Data

Jul. 8, 2016 (KR) ..... 10-2016-0086912

(51) Int. Cl.

| | |
|---|---|
| ***F25D 5/02*** | (2006.01) |
| ***F25D 17/06*** | (2006.01) |
| ***F25D 21/08*** | (2006.01) |
| ***F25D 21/14*** | (2006.01) |
| ***F25D 23/00*** | (2006.01) |
| ***F25D 23/06*** | (2006.01) |
| ***F25B 5/02*** | (2006.01) |

(52) U.S. Cl.

CPC ..... *F25D 17/067* (2013.01); *F25B 5/02* (2013.01); *F25D 17/065* (2013.01); *F25D 21/08* (2013.01); *F25D 21/14* (2013.01); *F25D 23/006* (2013.01); *F25D 23/069* (2013.01); *F25D 2201/126* (2013.01); *F25D 2400/00* (2013.01)

(58) Field of Classification Search

CPC ..... F25D 21/14
USPC ..... 62/285–291
See application file for complete search history.

(56) References Cited

U.S. PATENT DOCUMENTS

| | | | | |
|---|---|---|---|---|
| 2,199,245 A | | 4/1940 | Newman | |
| 4,150,551 A | | 4/1979 | Eisler | |
| 4,509,338 A | * | 4/1985 | Gould | F24F 13/22 62/288 |
| 8,695,368 B2 | * | 4/2014 | Yoon | F25D 21/04 62/273 |

(Continued)

FOREIGN PATENT DOCUMENTS

| | | |
|---|---|---|
| JP | S 55-114473 | 8/1980 |
| JP | S 60-228876 | 11/1985 |

(Continued)

OTHER PUBLICATIONS

Alienergy: "orABSROPTION & REFLECTION", Dec. 31, 2015 (Dec. 31, 2015), XP055411578, Retrieved from the Internet: URL: http://www.alienergy.org.uk/wp-content/uploads/2015/01/absorption_and_reflection.pdf [retrieved on Sep. 29, 2017] * the whole document *.

(Continued)

*Primary Examiner* — Filip Zec
(74) *Attorney, Agent, or Firm* — Ked & Associates, LLP

(57) ABSTRACT

An evaporating device includes: an evaporator, a defrost heater, and an evaporation pan, wherein the evaporation pan is made of aluminum and the inner side of the evaporation pan is coated with a surface treatment to improve the melting of ice in the evaporation pan.

13 Claims, 13 Drawing Sheets

(56) References Cited

U.S. PATENT DOCUMENTS

| | | | | |
|---|---|---|---|---|
| 2004/0182100 | A1* | 9/2004 | Lee | F25D 21/14 62/285 |
| 2005/0044862 | A1* | 3/2005 | Vetrovec | B01D 5/0066 62/93 |

FOREIGN PATENT DOCUMENTS

| | | |
|---|---|---|
| JP | H 03-274370 | 12/1991 |
| KR | 10-2013-0070309 | 6/2013 |

OTHER PUBLICATIONS

European Search Report dated Oct. 12, 2017 issued in Application No. 17180270.5.

* cited by examiner

EVAPORATOR DRIP PAN HAVING A HEAT ABSORBING COATED INNER SURFACE

CROSS-REFERENCE TO RELATED APPLICATIONS

This application claims priority under 35 U.S.C. § 119 to Korean Patent Application No. 10-2016-0086912 filed on Jul. 8, 2016 in Korea, whose entire disclosure is hereby incorporated by reference.

BACKGROUND

1. Field

An evaporating unit and a refrigerator having the same are disclosed herein.

2. Background

A refrigerator is an appliance for keeping food at refrigerating and freezing temperature. A refrigerator includes an evaporating chamber for cooling air at low temperature in the refrigerator and an evaporator that is a part of the refrigeration cycle is provided in the evaporating chamber. Further, an evaporation pan is provided under the evaporator to collect frost or ice separated from the surface of the evaporator in a defrosting process.

A sheath heater is coupled to the bottom of the evaporator and includes an electric wire, a cold pin with an end connected to the end of the electric wire, and a heating wire connected to the other end of the cold pin. The cold pin is a non-heating member provided to prevent the coating of the electric wire from melting due to high-temperature heat from the heating wire.

The cold pin is provided on an edge of the lower end of the evaporator. The cold pin is bent in an L-shape and provided over the lower end of a side and the bottom of the evaporator. During the defrosting process, ice on the evaporator melts and drops to the evaporator pan and the ice is then melted by heat radiated from the sheath heater.

Recently, superhydrophobic coating has been applied to the surfaces of evaporators, so that ice on the evaporators is quickly melted and separated by heat from a heater. Accordingly, it is possible to achieve an effect of reducing the defrosting time.

However, as the defrosting time is reduced, a freezing operation may restart without fully melting the ice in the evaporation pan in some cases. Accordingly, water produced in the evaporator in the freezing operation drops to the ice in the evaporation pan and freezes. In particular, the ice produced around the lower edge of the evaporator where the cold pin is provided does not melt at a proper time, so the ice grows in the freezing operation. The related art evaporator is shown in the following related art document, which is hereby incorporated by reference in its entirety: Korean Patent Application Publication No. 2013-0070309 (Jun. 27, 2013).

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

Figure 1:
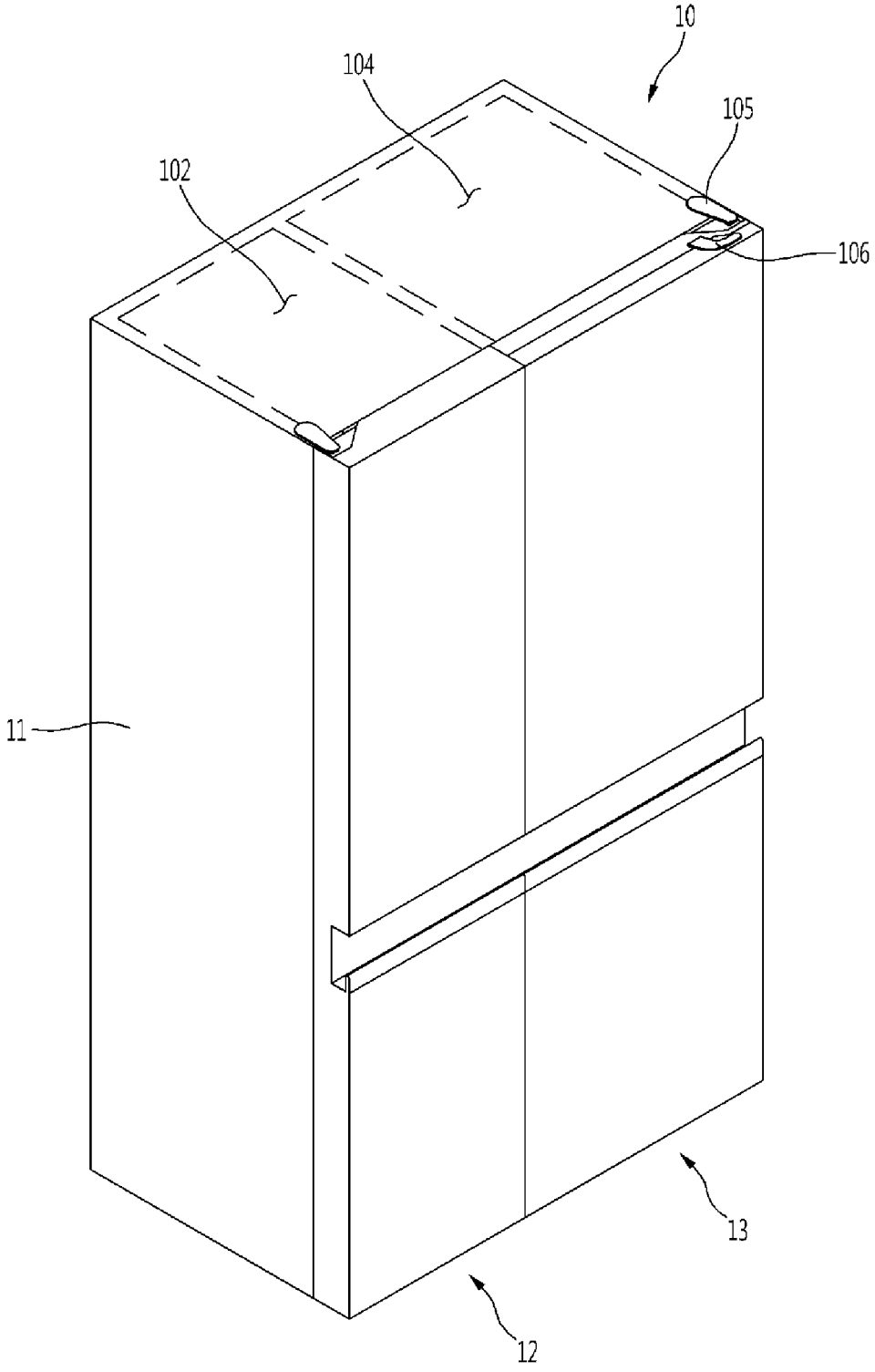
FIG. 1 is a perspective view of a refrigerator including an evaporation pan according to an embodiment of the present disclosure.

Hereinafter, a refrigerator including an evaporation pan according to an embodiment of the present disclosure will be described in detail with reference to the accompanying drawings. FIG. 1 is a perspective view of a refrigerator including an evaporation pan according to an embodiment and FIG. 2 is a rear view of the refrigerator.

Figure 2:
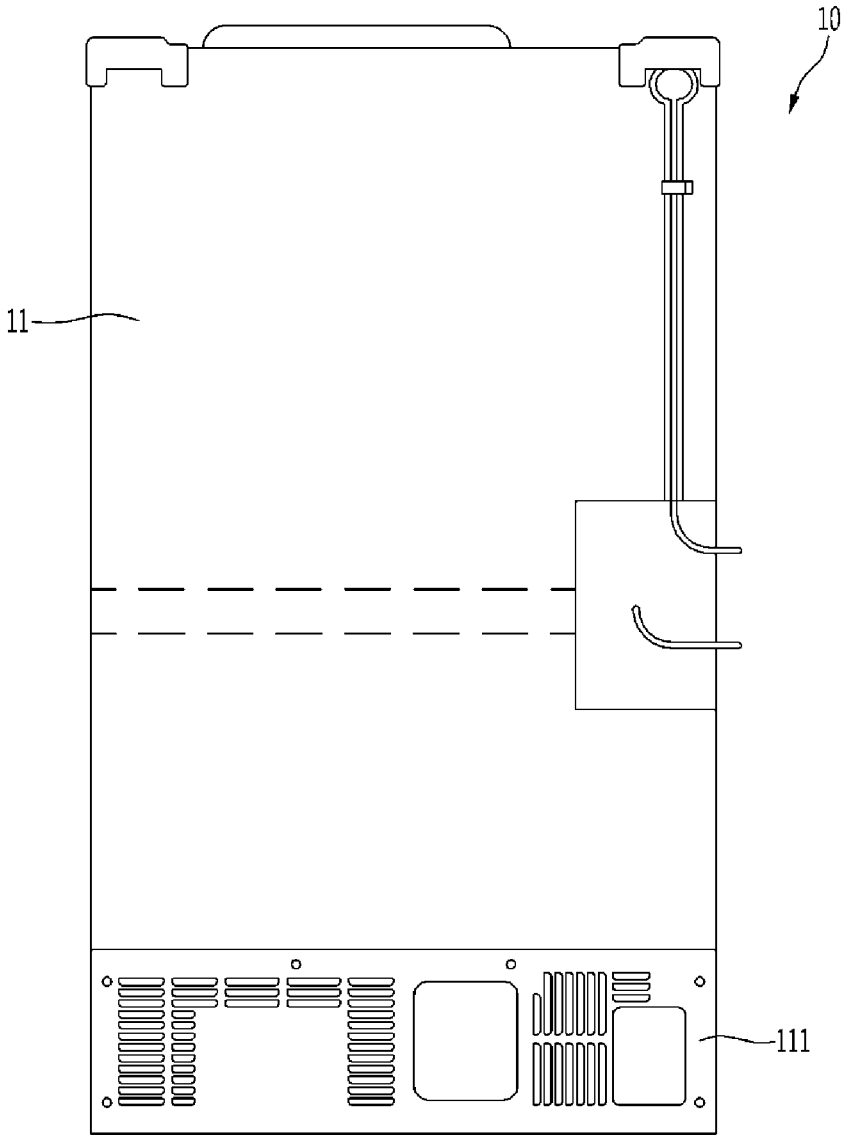
FIG. 2 is a rear view of the refrigerator.

Referring to FIGS. 1 and 2, a refrigerator 10 according to an embodiment may include a cabinet 11 having storage compartments therein, doors rotatably coupled to the front of the cabinet 11 to open/close the storage compartments, and a cooling cycle to cool the storage compartments. The storage compartments may include a refrigerator compartment 104 and a freezer compartment 102 and a machine room to hold the parts of the cooling cycle may be formed in the lower rear portion of the cabinet 11. The machine room may be covered with a machine room cover 111 and the machine room cover 111 may have external air inlet grills and exit grills.

The doors may include a refrigerator door 13 to open/close the refrigerator compartment 104 and a freezer door 12 to open/close the freezer compartment 102. The refrigerator door 13 and the freezer door 12 may be rotatably coupled to the cabinet 11 by hinges. Depending on refrigerators, any one or both of the refrigerator door 13 and the freezer door 12 may be formed as a door-in-door type with doors arranged front and back.

A door-in-door type may include a first door rotatably coupled to the front of the cabinet 11 by a first hinge 105 to open/close the refrigerator compartment 103 or the freezer compartment 102, and a second door rotatably coupled to the front of the first door by a second hinge 106. The second door is in close contact with the front of the first door and may rotate in the same direction as the first door.

An opening may be formed through the first door and a storage space may be formed on the rear of the first door. Accordingly, it may be possible to take out food from the storage space or put food into the storage space through the opening with the first door closed.

The second door may selectively open/close the opening in front of the first door. When the first door is closed and the second door is open, the opening is open, so a user may put food into the storage space.

The freezer door 12 and the refrigerator door 13 may be the same size, or one may be larger than the other in width. In general, the refrigerator door 13 may be larger in width than the freezer door 12. Shelves and cases for keeping food may be provided inside the storage compartments and a plurality of storage members such as a door basket may be provided on the rears of the doors.

Figure 3:
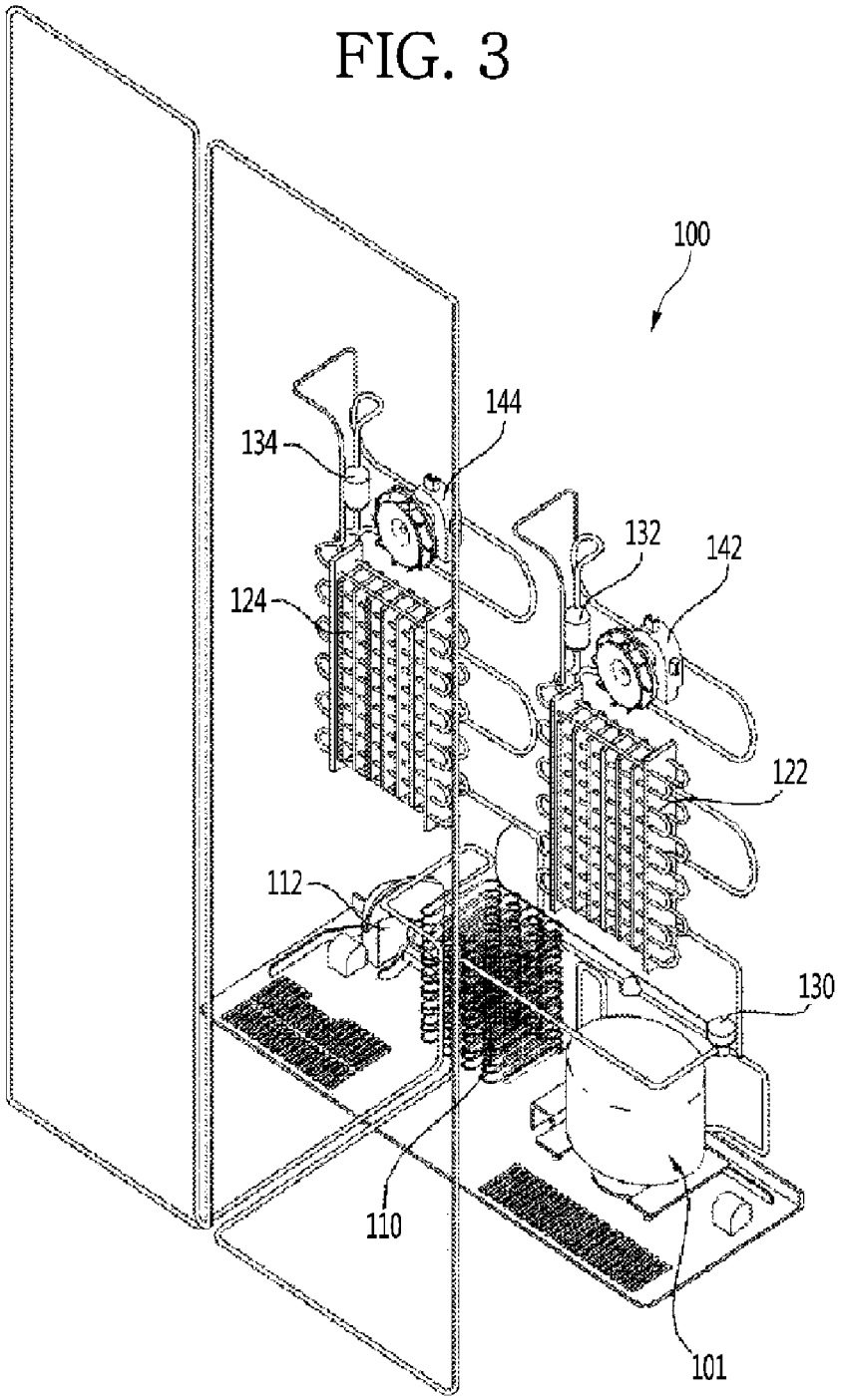
FIG. 3 shows the configuration of a cooling cycle of the refrigerator according to an embodiment.
Figure 4:
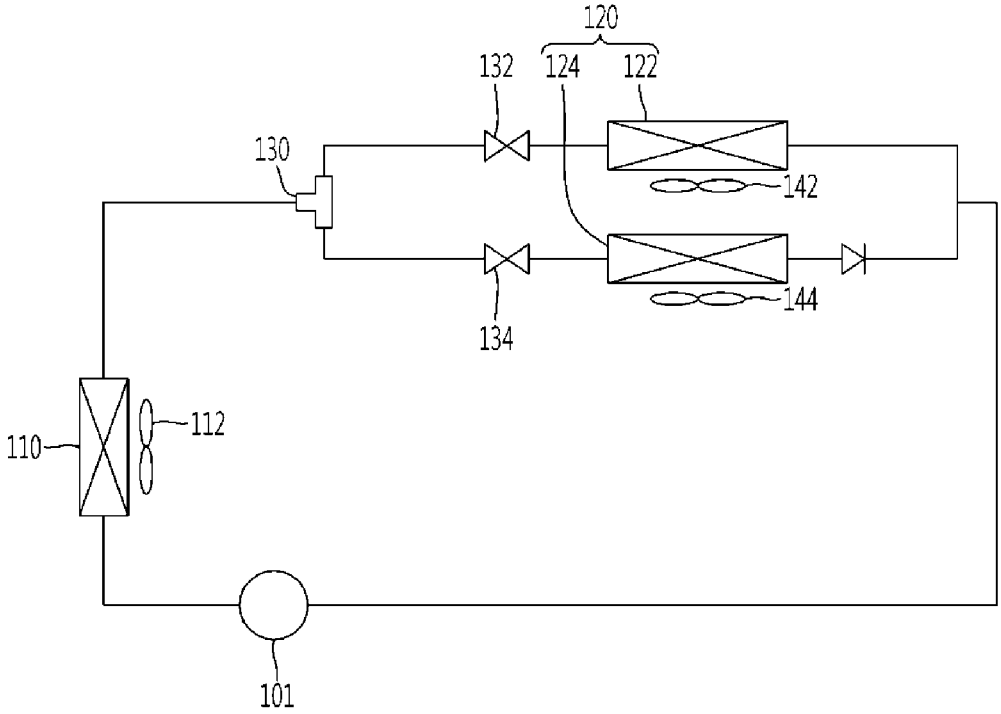
FIG. 4 is a system diagram of the cooling cycle.

FIG. 3 shows the configuration of a cooling cycle of the refrigerator according to an embodiment and FIG. 4 is a system diagram of the cooling cycle. Referring to FIGS. 3 and 4, a cooling cycle 100 of the refrigerator according to an embodiment may include a compressor 101 that compresses a refrigerant into a high-temperature and high-pressure gaseous refrigerant, a condenser 110 that condenses the refrigerant from the compressor 101 into a high-temperature and high-pressure liquid refrigerant, a condenser fan 112 that blows internal air so that the internal air exchanges heat with the condenser 110, an expansion valve that expands the refrigerant from the condenser 110 into a low-temperature and low-pressure two-phase refrigerant, and an evaporator 120 that evaporates the two-phase refrigerant passing through the expansion valve into a low-temperature and low-pressure gaseous refrigerant.

The evaporator 120 may include a refrigerator evaporator 122 and a freezer evaporator 124 and the expansion valve may include a refrigerator expansion valve 132 and a freezer expansion valve 134. The refrigerator expansion valve 132 may be provided at the inlet of the refrigerator evaporator 122 and the freezer expansion valve 134 may be provided at the inlet of the freezer evaporator 124.

A refrigerator evaporator fan 142 and a freezer evaporator fan 144 may be provided close to the refrigerator evaporator 122 and the freezer evaporator 124, respectively, to make the cold air in the refrigerator compartment and the freezer compartment exchange heat with the refrigerator evaporator 122 and the freezer evaporator 124. The refrigerant that has passed through the condenser 110 may be distributed to the refrigerator expansion valve 132 and the freezer expansion valve 134 by a 3-way valve 130.

Figure 5:
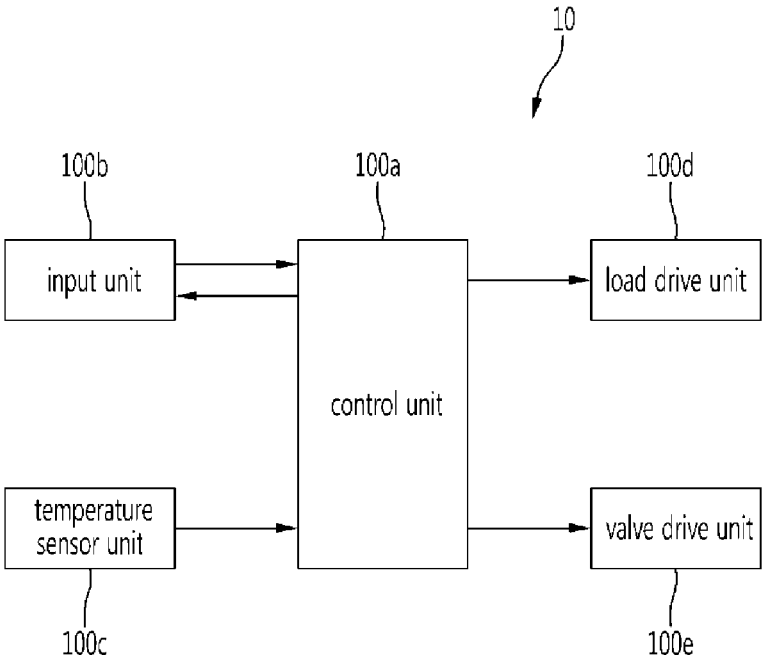
FIG. 5 is a block diagram illustrating control of the operation of the refrigerator according to an embodiment.

Referring to FIG. 5, an operation control system for the refrigerator may include an input unit (or input) 100*b* that functions as a user interface, a temperature sensor unit (or temperature sensor) 100*c* that senses the temperature of the refrigerator compartment 104 and the freezer compartment 102, a load drive unit (or load drive) 100*d* that drives the compressor 101 and the fans, a valve drive unit (or valve drive) 100*e* that controls the operation of the 3-way valve 130, and a control unit (or controller) 100*a* that controls the load drive unit 100*d* and the valve drive unit 100*e*.

The control unit 100*a* may receive an input for an operating condition from the input unit 100*b* and the internal temperature of the refrigerator from the temperature sensor unit 100*c*. The control unit 100*a* may control the operation of the load drive unit 100*d* and the valve drive unit 100*e* in accordance with the operating condition input through the input unit 100*b*. Accordingly, the cooling cycle and the fans may be operated by the load drive unit 100*d* and the 3-way valve 130 may be operated by the valve drive unit 100*e*, whereby the flow direction of a refrigerant is determined.

Figure 6:
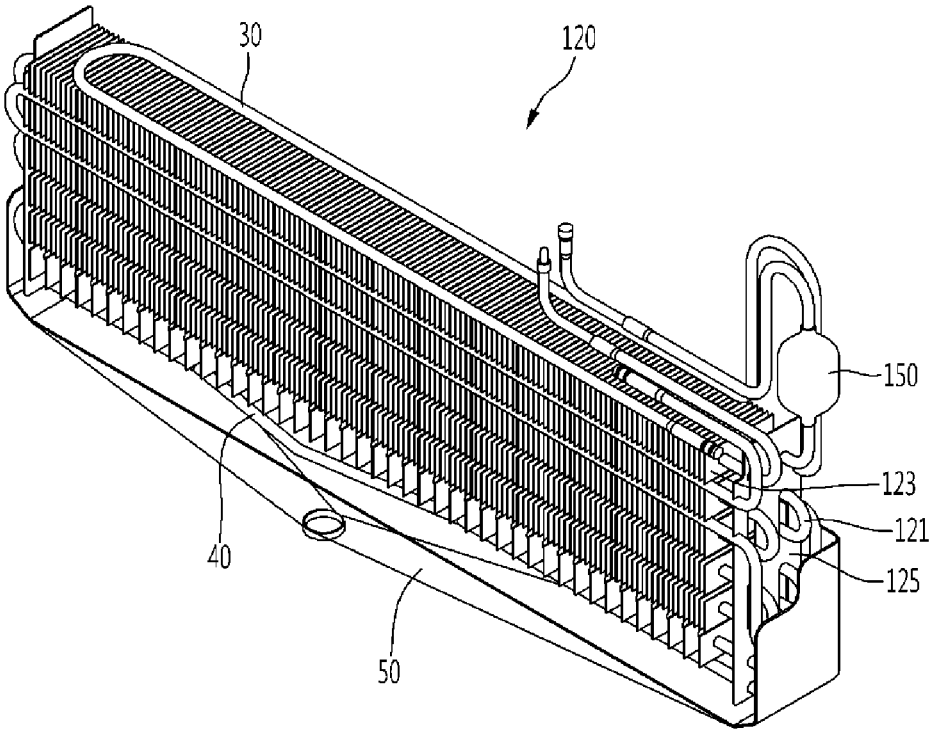
FIG. 6 is a perspective view of an evaporating unit according to an embodiment.
Figure 7:
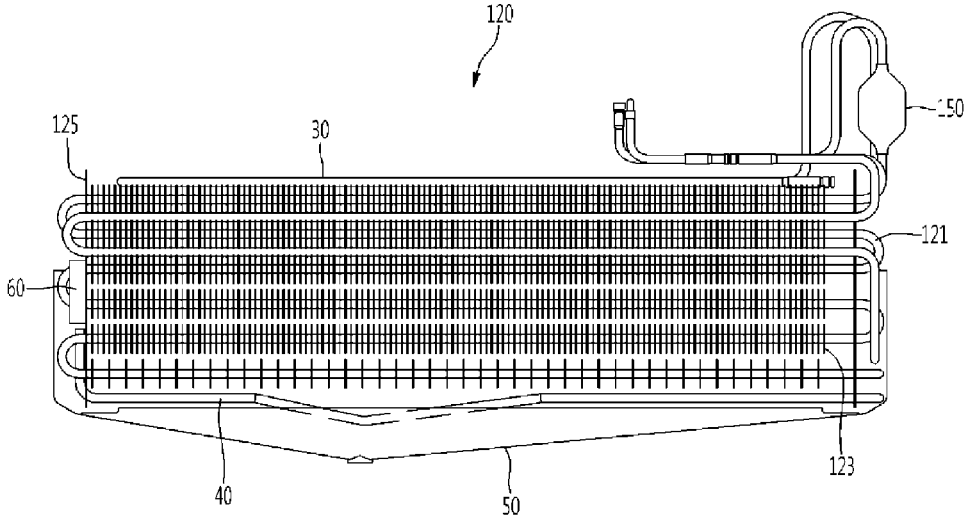
FIG. 7 is a front view of the evaporating unit.

The evaporator 120 of the evaporating unit to be described hereafter may be a refrigerator evaporator or a freezer evaporator. Referring to FIGS. 6 and 7, an evaporating unit according to an embodiment may include an evaporator 120 through which cold air and a refrigerant exchange heat with each other, an L-cord heater 30 provided on the evaporator 120, a sheath heater 40 provided under the evaporator 120, an evaporation pan 50 that collects frost or ice dropping from the surface of the evaporator 120, and a temperature sensor 60 that is mounted on the evaporator 120.

The evaporator 120, as shown in the figures, may include an evaporator pipe 121 through which the refrigerant that has passed through the evaporator expansion valve flows, a plurality of heat exchanger fins 123 arranged in the longitudinal direction of the evaporator pipe 121 and through which the evaporator pipe 121 passes, an accumulator 150 that is provided at the outlet end of the evaporator pipe 121 to separate a liquid refrigerant and a gaseous refrigerant, and an evaporator frame 125 that holds the evaporator pipe.

The evaporator pipe 121 may be bent to make a meander line. The heat exchanger fins 123 may be arranged in parallel in a line and the evaporator pipe 121 may sequentially pass through the heat exchanger fins 123. Accordingly, the evaporator pipe 121 and the heat exchanger fins 123 may exchange heat with each other through conduction and exchange heat with the cold air in an evaporating chamber.

The points of time to start and finish defrosting may be determined on the basis of the temperature sensed by the temperature sensor 60. The L-cord heater 30 may be provided in a meander line along the upper portions of the front and rear and the top of the evaporator 120 and melt frost on the evaporator 120.

The sheath heater 40 may extend in a U-shape along the bottom and sides of the evaporator 120. A first end of the sheath heater 40 may extend down along a first side of the evaporator 120 and bend at the edge of the lower end of the evaporator 120. The sheath heater 40 bending at the edge of the lower end of the evaporator 120 may extend to a second side of the evaporator 120 from the lower end of the evaporator 120, smoothly bend in a U-shape on the second side of the evaporator 120, and then extend to the first side of the evaporator 120.

A second end of the sheath heater 40 may bend upward and then extend along the first side of the evaporator. Accordingly, both ends of the sheath heater 40 may be positioned at the same side of the evaporator 120. The sheath heater 40 may extend at the lower end of the evaporator 120 and may bend one time or more.

According to this configuration, when a defrosting operation is started, the refrigerant flowing through the evaporator pipe 121 may stop and power may be supplied to the L-cord heater 30 and the sheath heater 40. Accordingly, the L-cord heater 30 and the sheath heater 40 may be heated and discharge heat, so the ice on the evaporator 120 starts to melt.

When the ice on the evaporator 120 melts, it may slide down and drop into the evaporation pan 50 due to gravity. The ice that has dropped into the evaporation pan 50 may change phase into water, so it may be collected into another evaporator pan on the bottom of the machine room or be discharged outside the refrigerator.

Figure 8:
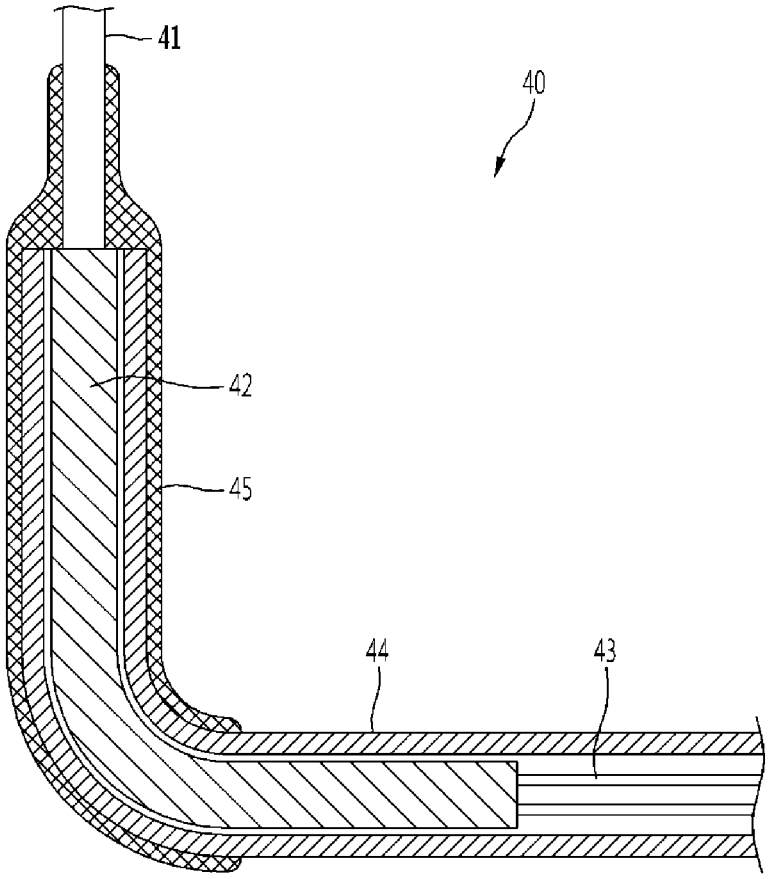
FIG. 8 is a partial vertical cross-sectional view showing the start portion of a sheath heater according to an embodiment.

Referring to FIG. 8, the sheath heater 40 proposed as an example of a defrost heater according to an embodiment may have a start portion and an end portion that are bent in close contact with a side of the evaporator 120. The start portion and the end portion of the sheath heater 40 may be in close contact with any one outer side of the evaporator frame 125 forming the left and right sides of the evaporator 120.

The sheath heater 40 may include a lead wire 41, a cold pin 42 that has a first end connected to the end of the lead wire, a heating wire 43 connected to a second end of the cold pin 42, a heating pipe 44 that has the cold pin 42 and the heating wire 43 therein, and a thermal contraction tube 45 that covers the end portion of the heating pipe 44. The cold pin 42 may include a vertical part and a horizontal part by bending at 90 degrees at a predetermined position. The vertical part of the cold pin 42 may be in close contact with the outer side of the evaporator frame 125 and the horizontal part may extend along the bottom of the evaporator 120.

When the heating wire 43 is directly connected to the lead wire 41, the coating of the lead wire 41 may melt or peel off due to heat from the heating wire 43. A non-heating section may be formed by interposing the cold pin 42 to prevent this problem. That is, even though power is supplied through the lead wire 41, the cold pin 42 may not be heated and only the heating wire 43 may be heated.

Since the cold pin 42 and the heating wire 43 are provided in the heating pipe 44 made of stainless steel (STS), they may be protected from external shock. The outer sides of a portion of the lead wire 41 and the end portion of the heating pipe 44 may be covered with the thermal contraction tube 45. The thermal contraction tube 45 may contract due to its properties when being heated. Accordingly, the joint of the lead wire 41 and the cold pin 42 may be sealed to be watertight and prevent galvanic corrosion due to different kinds of metal.

In other words, when the heating pipe 44 made of stainless steel and the heat exchanger pipe 121 made of aluminum are brought in direct contact with each other, corrosion may occur due to a potential difference between different kinds of metal. However, when the thermal contraction tube 45 covers the outer side of the heating pipe 44, corrosion due to a potential difference between different kinds of metal may be prevented.

Since the cold pin 42 forms the non-heating section, the defrosting ability may be low at the edge of the lower end of the evaporator 120 where the cold pin 42 is positioned, relative to the other portion. Further, frost or ice in the evaporation pan 50 under the cold pin 42 may not completely melt during the defrosting operation. In order to solve this problem, thermal conductivity and thermal radiation efficiency may be improved by changing the material and the color of the evaporation pan 50.

Figure 9:
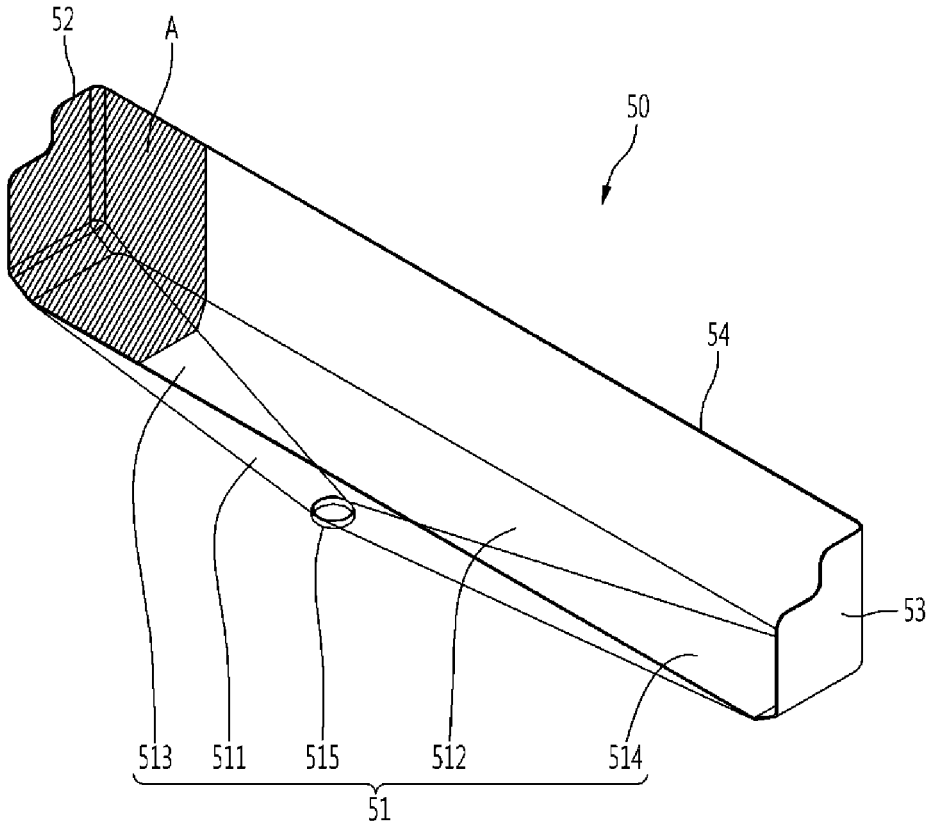
FIG. 9 is a front perspective view of an evaporation pan according to an embodiment.

Referring to FIG. 9, an evaporation pan 50 may be provided on the bottom of the evaporating chamber, collect defrost water dropping from the evaporator 120, and discharge the defrost water outside the refrigerator during the defrosting operation. The evaporation pan 50 may have a defrost water collection portion or tray 51 having an open top, a left wall 52 extending upward from the left upper end of the defrost water collection portion 51, a right wall 53 extending upward from the right upper end of the defrost water collection portion 51, and a rear wall 54 extending upward from the rear upper rend of the defrost water collection portion 51.

The defrost water collection portion 51 may have a front side 511, a rear side 512, a left floor 513, a right floor 514, and a drain hole 515. The drain hole 515 may be formed at a position that bisects the width of the defrost water collection portion 51 or may be formed at a predetermined position closer to the left edge or the right edge from the bisecting position.

The left floor 513 and the right floor 514 may be inclined to meet each other at the drain hole 515. Further, the front side 511 and the rear side 512 may also be inclined to meet each other at the drain hole 515. In other words, a side cross-section and a front cross-section of the defrost water collection portion 51 that are cut by a vertical plane passing through the drain hole 515 may become narrower as they approach the bottom, thereby forming a conical or an inverse triangular shape that converges on the drain hole 515.

As described above, the defrost water collection portion 51 may be inclined to converge on the drain hole 515, so defrost water dropping to the defrost water collection portion 51 may be collected to the drain hole 515 and guided to a defrost water tray on the bottom of the machine room or discharged outside the refrigerator. When the ice sliding down on the evaporator 120 drops to the defrost water collection portion 51 during the defrosting operation, the ice may completely change phase into water and may be discharged outside through the drain hole 515 before the defrosting operation is finished.

However, the ice dropping to the portion where the cold pin 42 of the sheath heater 40 is positioned, that is, to the left floor 513 or the right floor 514 of the defrosting water collection portion 51 may not completely melt. This is because the cold pin 42 may be the non-heating portion, so the defrost water collection portion 51 cannot sufficiently absorb radiant heat. Accordingly, due to the insufficient absorption of radiant heat, the ice that has dropped to the defrost water collection portion 51 may not melt.

In order to solve this problem, the defrost heater, in detail, the evaporation pan 50 may absorb the radiant heat from the sheath heater 40 as much as possible within a predetermined time. Further, a material having high thermal conductivity may be used for the evaporation pan 50 so that the radiant heat absorbed by the evaporation pan 50 quickly transfers to the ice in the evaporation pan 50.

To this end, the evaporation pan 50 may be made of aluminum having high thermal conductivity. Since the thermal conductivity of aluminum is higher than that of steel, the melting speed of ice may be increased.

Further, it may be possible to apply a flat black coating on the inner side of the evaporation pan 50. When the inner side of the evaporation pan 50 is coated with a black paint, the thermal absorption amount may be increased, as compared with when the evaporation pan 50 has a white surface. Therefore, the ice in the evaporation pan 50 may melt more quickly.

The black coating may be partially applied only to the area A close to the side of the evaporation pan 50 where the cold pin 42 is positioned. The portion coated with the black paint may be defined as a coated portion or a black coated portion.

The black paint applied to the inner side of the evaporation pan 50 may include a polyester resin of 40%, epoxy resin of 30%, a filler (barium) of 20%, and a filler (feldspar) of 10%. Further, the coating thickness may be about 30 μm~70 μm, preferably 30 μm~70 μm, and more preferably 50 μm.

If the coating thickness of the coated portion is less than 30 μm, the coating effect may be reduced, so the possibility of poor coating is high and the ability of absorbing radiant heat is reduced. In contrast, when the coating thickness of the coated portion is larger than 70 μm, an orange peel phenomenon may occur, that is, depressions and recessions such as the peel of an orange may be made.

An evaporation pan 50 (Sample 1) made of aluminum (heat transfer coefficient: 0.22 Kcal/Kg° C. and thermal conductivity: 205.0 W/mK) and coated with a black paint on the entire inner side and an evaporation pan 50 made of steel (heat transfer coefficient: 0.115 Kcal/Kg° C. and thermal conductivity 79.5 W/mK) and having a white inner side without being coated with a black paint were experimented in defrosting operations under the same conditions. Further, the temperatures of the left floors 513 of the evaporation pans 50 were measured after the defrosting operations. The results are shown in the following table.

TABLE 1

| Sample 1 | | Sample 2 | |
|---|---|---|---|
| First experiment | Second experiment | First experiment | Second experiment |
| 1.5° C. | 2.6° C. | 0.2° C. | 0° C. |

Figure 10:
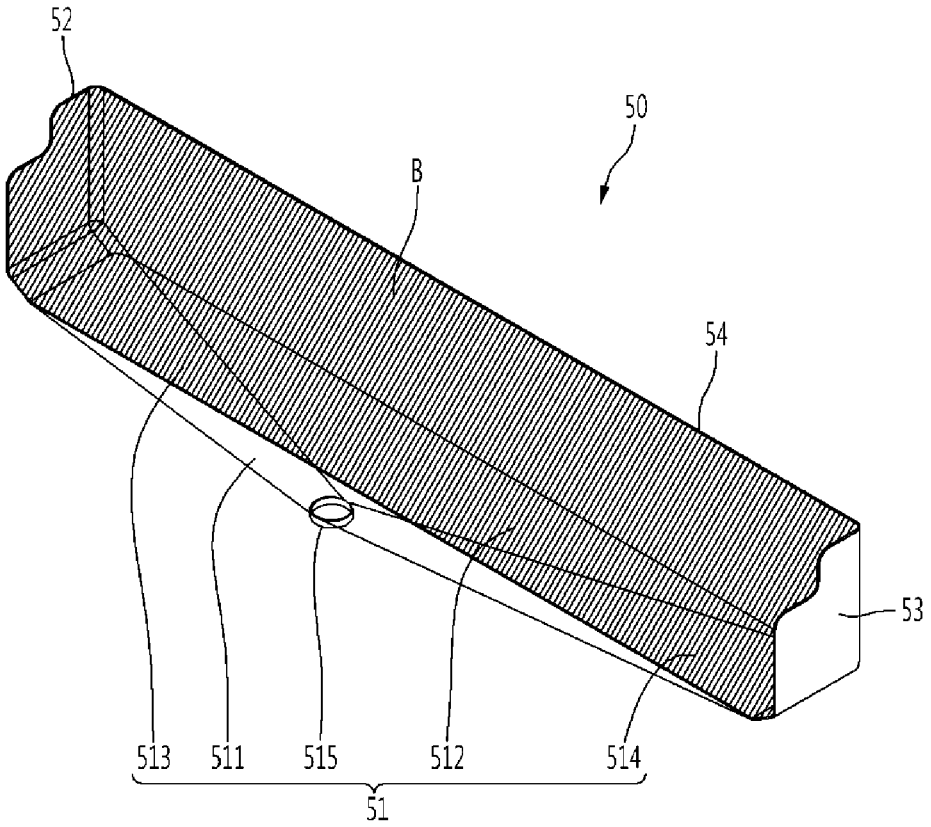
FIG. 10 is a front perspective view of an evaporation pan according to an embodiment.

Referring to FIG. 10, a coated portion B may be formed throughout the inner side of the evaporation pan 50. Accordingly, the evaporation pan 50 may absorb more radiant heat, so the ice in the evaporation pan 50 may melt more quickly.

Figure 11:
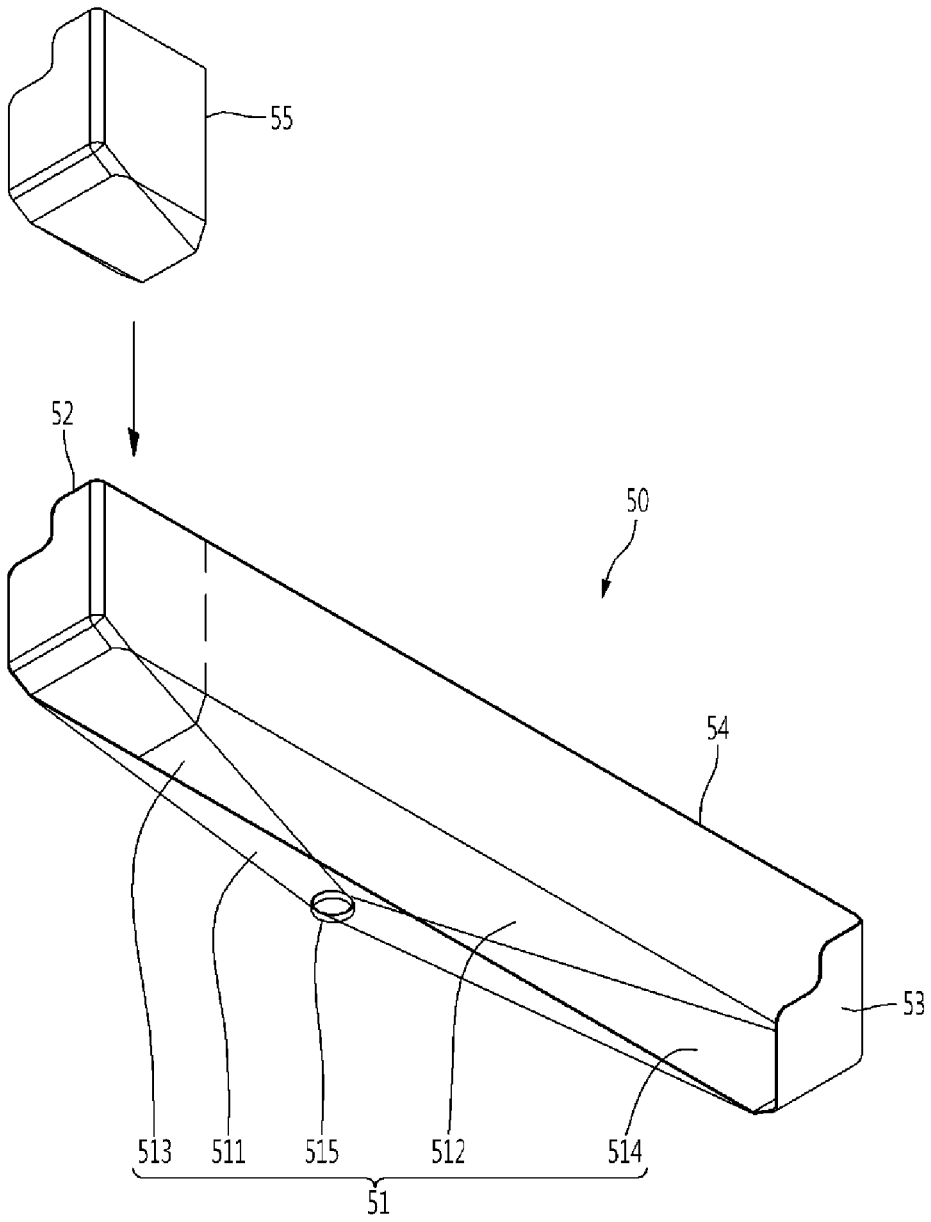
FIG. 11 is an exploded perspective view of an evaporation pan according to another embodiment.

Referring to FIG. 11, a heat absorbing pad 55 may be attached to the inner side of the evaporation pan 50 instead of coating the inner side of the evaporation pan 50 in order to improve the ability of absorbing heat. The heat absorbing pad 55 may be partially attached only to the portion where the cold pin 42 is positioned. Further, it may be possible to attach the heat absorbing pad 55 onto the a first portion of the inner side of the evaporation pan 50 and apply black paint to a second portion of the inner side of evaporation pad 50 except for the portion where the heat absorption pad 55 is attached.

Figure 12:
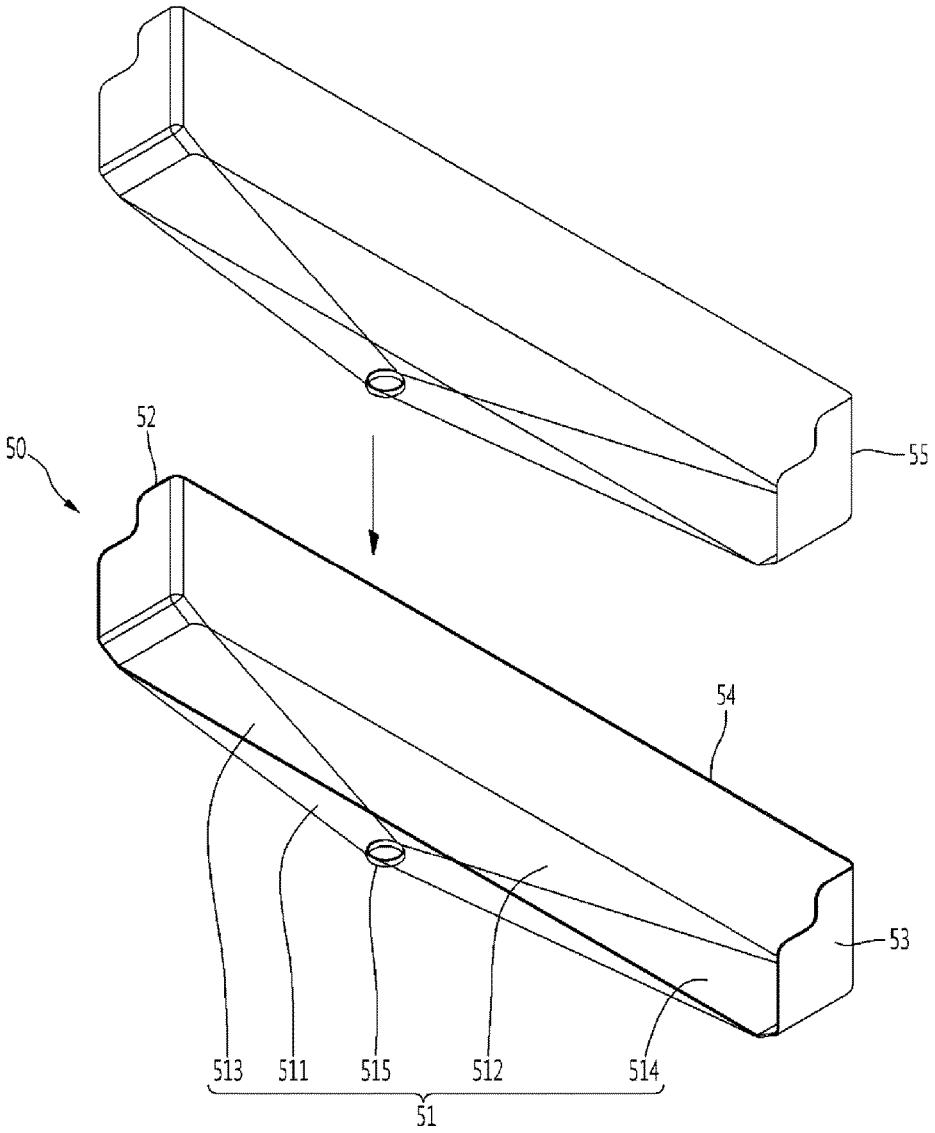
FIG. 12 is an exploded perspective view of an evaporation pan according to another embodiment.
Figure 13:
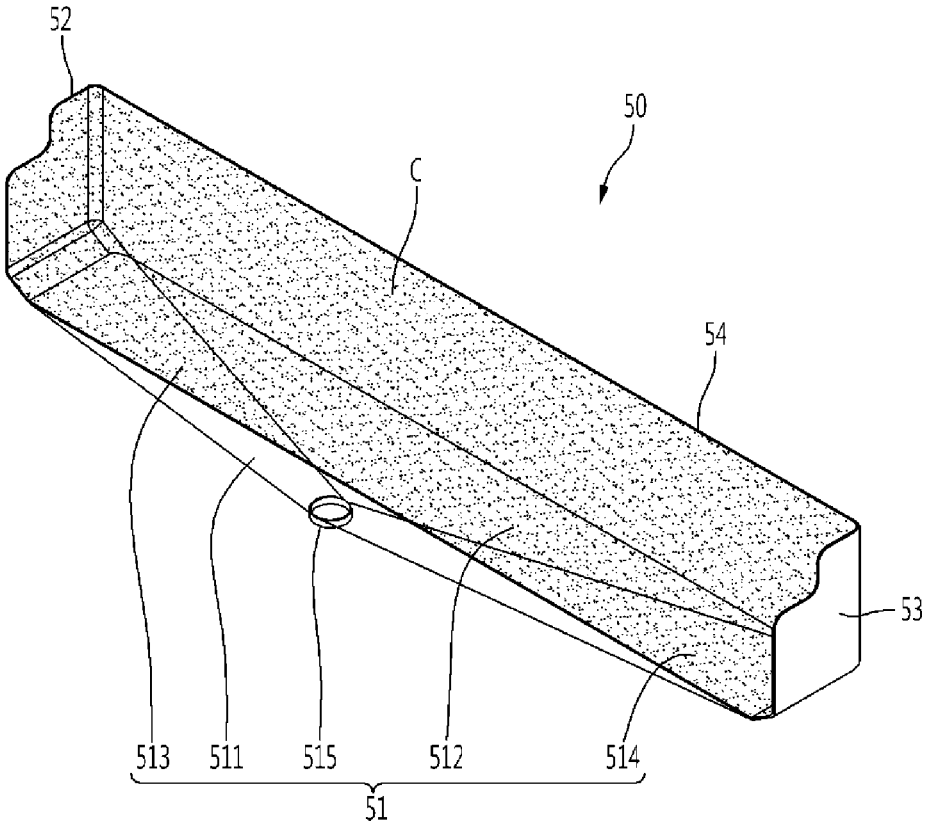
FIG. 13 is a front perspective view of an evaporation pan according to another embodiment.

Referring to FIG. 12, the heat absorption pad 55 may be attached to the entire inner side of the evaporation pan 50. Referring to FIG. 13, anodizing surface treatment may be applied to the entire inner side of the evaporation pan or the portion corresponding to the cold pin 42. It may be possible to improve the ability of absorbing heat by applying anodizing surface treatment to the inner side of the evaporation pan 50 that absorbs heat. The portion to which anodizing surface treatment is applied may be defined as an anodizing surface-treated portion C.

In other words, it may be possible to reduce the amount of heat energy that is reflected by the evaporation pan 50 by anodizing the inner side of the evaporation pan 50 with high surface roughness. The portion that is anodized may be defined as an anodized portion. It may be possible to apply only any one of a black coating, a heat absorbing pad, or anodizing surface treatment, or partially apply combinations of the three methods to the inner side of the evaporation pan 50.

An evaporating unit according to an embodiment may include: an evaporator that includes an evaporator pipe, a frame supporting the evaporator pipe, and a plurality of heat exchanger fins through which the evaporator pipe passes; a defrost heater mounted on the evaporator; and an evaporation pan provided under the evaporator that collects and discharges water or ice that drops from the surface of the evaporator due to heat from the defrost heater, on which a surface treatment portion (or surface treatment) for absorbing radiant heat from a sheath heater is formed on the entire or a portion of the inner side of the evaporation pan. The surface treatment portion may include any one or combinations of at least two or more of a coated portion with black paint, a heat absorbing pad, and an anodized portion.

The black paint may include polyester resin of 40%, epoxy resin of 30%, a barium filler of 20%, and a feldspar filler of 10%. The coated portion may have a thickness of 40~60 μm. The coated portion may have a thickness of 50 μm.

The defrost heater may include the sheath heater having a cold pin, and the surface treatment portion may be formed on the inner side of the evaporation pan that corresponds at least to the area under the cold pin. The evaporation pan may receive the lower portion of the evaporator and the surface treatment portion may cover the cold pin at least one of first and second sides of the evaporation pan.

The defrost heater may be bent at the edge of a side of the evaporator, and the surface treatment portion may be formed in an area inside the evaporation pad that corresponds to the bending portion of the defrost heater. At least a portion including the surface treatment portion of the evaporation pan may be made of aluminum.

The surface treatment portion may be rougher than the other inner side of the evaporation pan except for the surface treatment portion. The anodized portion may have a rougher surface than the other inner side of the evaporation pan.

The heat absorbing pad may be formed in a shape corresponding to the evaporation pan and attached to the evaporation pan. The heat absorbing pad may be formed at an area corresponding to the cold pin of the defrost heater, throughout side walls forming the sides of the evaporation pan, a defrost water collection portion forming the bottom of the evaporation pan, and a rear wall supporting the rear of the evaporation pan. The heat absorbing pad may be formed throughout the inner side of the evaporation pan to receive the cold pin of the defrost heater.

A refrigerator according to another embodiment may include: a cabinet having storage compartments to hold food and an evaporating chamber to produce cold air; doors coupled to the cabinet to open and close the storage compartments; and an evaporating unit provided in the evaporating chamber. An evaporating unit according to an embodiment and a refrigerator including the evaporating unit, which include the configuration described above, have the following effects. First, since the evaporation pan is made of aluminum having relatively high thermal conductivity instead of steel, heat may quickly transfer to the ice in the evaporation pan, so the ice may quickly melt.

Second, since the evaporation pan may be made of aluminum and may be coated with black paint or undergo anodizing surface treatment, or a heat absorbing pad may be attached to the evaporation pan, the evaporation pad may absorb radiant heat from the defrost heater as much as possible, so heat may quickly transfer to the ice in the evaporation pan. Third, since the heat discharged downward from the defrost heater on the bottom of the evaporator may be absorbed by the evaporation pan, it may be possible to prevent an inner case of the refrigerator that forms the bottom of the evaporator from melting.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An evaporating device comprising:

an evaporator, the evaporator including:

an evaporator pipe including a plurality of bends;

a pair of frames supporting the evaporator pipe, the pair of frames including a first frame supporting a first section of the evaporator pipe and a second frame supporting a second section of the evaporator pipe; and a plurality of heat exchanger fins arranged between the pair of frames and through which the evaporator pipe passes;

a defrost heater mounted on the evaporator, the defrost heater including:

a cold pin comprising a vertical portion in close contact with an outer surface of one of the pair of frames and a horizontal portion horizontally bent at a lower end of the vertical portion to extend along a bottom of the evaporator;

a lead wire connected to a first end of the cold pin; and a heating wire connected to a second end of the cold pin;

an evaporation pan configured to accommodate at least a portion of the evaporator and to collect and discharge water or ice that drops from a surface of the evaporator; and a surface treatment that is formed on an inner surface of the evaporation pan to absorb radiant heat from the defrost heater, wherein the surface treatment is formed at an area under the cold pin of the defrost heater.

2. The evaporating device of claim 1, wherein the surface treatment includes any one of or a combination of at least two or more of a coating of black paint, a heat absorbing pad, and an anodized portion.

3. The evaporating device of claim 2, wherein the black paint includes a mixture containing 40% of polyester resin, 30% of epoxy resin, 20% of a barium filler, and 10% of a feldspar filler.

4. The evaporating device of claim 2, wherein the coating has a thickness of 40~60 μm.

5. The evaporating device of claim 2, wherein the coating has a thickness of 50 μm.

6. The evaporating device of claim 1, wherein the defrost heater further includes:

a heating pipe surrounding the cold pin; and a thermal contraction tube surrounding a portion of the heating pipe and a portion of the lead wire.

7. The evaporating device of claim 2, wherein at least a portion of the evaporation pan including the surface treatment is made of aluminum.

8. The evaporating device of claim 2, wherein a first portion of an inner side of the evaporation pan having the surface treatment is rougher than a second portion of the inner side of the evaporation pan.

9. The evaporating device of claim 2, wherein a first portion of an inner side of the evaporation pan having the anodized portion has a rougher surface than a second portion of the inner side of the evaporation pan.

10. The evaporating device of claim 2, wherein the heat absorbing pad has a shape corresponding to the evaporation pan and is attached to the evaporation pan.

11. The evaporating device of claim 10, wherein the heat absorbing pad is formed along the area under the cold pin of the defrost heater, throughout side walls forming sides of the evaporation pan, over a defrost water collection portion forming a bottom of the evaporation pan, and over a rear wall supporting a rear of the evaporation pan.

12. The evaporating device of claim 11, wherein the heat absorbing pad is formed throughout the inner surface of the evaporation pan to receive the cold pin of the defrost heater.

13. A refrigerator comprising:

a cabinet having storage compartments to store food and an evaporating chamber to produce cold air;

doors coupled to the cabinet to open and close the storage compartments; and the evaporating device of claim 1 provided in the evaporating chamber.

* * * * *